US005190138A

United States Patent [19]

Strasser et al.

[11] Patent Number: 5,190,138

[45] Date of Patent: Mar. 2, 1993

[54] APPARATUS FOR FILLING A TRANSPORT CONTAINER

[75] Inventors: Karl-Heinz Strasser, Berg b. Ravensburg; Martin Röck, Tettnang, both of Fed. Rep. of Germany

[73] Assignee: Handtmann A-Punkt Automation GmbH, Baienfurt, Fed. Rep. of Germany

[21] Appl. No.: 667,105

[22] Filed: Mar. 8, 1991

[30] Foreign Application Priority Data

Mar. 12, 1990 [DE] Fed. Rep. of Germany ..... 4007801

[51] Int. Cl.[5] ..... B65G 47/04

[52] U.S. Cl. ..... 198/468.8; 198/470.1

[58] Field of Search ..... 198/468.8, 470.1, 476.1, 198/477.1, 429

[56] References Cited

U.S. PATENT DOCUMENTS

| | | | |
|---|---|---|---|
| 3,311,215 | 3/1967 | Clark et al. | 198/468.8 X |
| 3,938,847 | 2/1976 | Peyton | 198/470.1 X |
| 4,512,456 | 4/1985 | Peyton | 198/470.1 |
| 4,574,428 | 3/1986 | Meyn | 198/470.1 X |
| 4,700,824 | 10/1987 | Vere et al. | 198/468.8 X |

FOREIGN PATENT DOCUMENTS

| | | | |
|---|---|---|---|
| 2164390 | 12/1977 | Fed. Rep. of Germany | 198/468.8 |
| 73394 | 6/1960 | France | 198/468.8 |
| 0113611 | 9/1981 | Japan | 198/468.8 |
| 0119476 | 1/1959 | U.S.S.R. | 198/468.8 |
| 1407883 | 7/1988 | U.S.S.R. | 198/468.8 |

*Primary Examiner*—D. Glenn Dayoan

*Attorney, Agent, or Firm*—Robert W. Becker & Associates

[57] ABSTRACT

An apparatus for the controllable filling of transport containers with piece goods is provided. The transport container is arranged vertically above the conveying device and comprises two halves that are controllably adjustable. A lifting member is provided under the conveying means which penetrates the conveying means in the direction of the transport containers and may be introduced into the transport containers. The lifting device is drivably connected to a control member that engages the halves of the transport containers. With the control member, one or both halves of the transport container may be adjusted with respect to the lifting movements of the lifting device. It is thus possible to automatically fill a transport container with piece goods in a single layer or multiple layers, without the piece goods being touched by personnel.

16 Claims, 7 Drawing Sheets

APPARATUS FOR FILLING A TRANSPORT CONTAINER

BACKGROUND OF THE INVENTION

The present invention relates to an apparatus for the controlled filling of transport containers with piece goods, especially for the introduction of sausages into a transport container.

Currently, sausages that have been portioned and twisted off in a sausage stuffing machine are removed from that machine manually and are then placed in packing containers of a subsequent packing unit. This method is not only laborious and expensive since up to five people are needed in order to convey the sausages coming from the sausage stuffing machine to the packing unit, but is also unhygienic. Each individual sausage must be picked up by hand and, at times, must be held for an extended period of time so that, during the time needed for a casing exchange in the sausage stuffing machine which is working at a high portioning speed, the packing unit which is working in cycles may be loaded. Manually conveying sausages from the sausage stuffing machine to the packing unit is therefore not economical and outdated.

It is therefore an object of the present invention to provide an apparatus with which it is possible to fill a transport container in a controllable manner with piece goods, especially for conveying sausages that have been portioned and twisted off by a sausage stuffing machine into packing containers of the packing unit, without the sausages having been touched by personnel. The piece goods or sausages are introduced in a single or multiple layers into the transport containers, and are then conveyed to the packing unit. The construction of such an apparatus should be kept simple and, at the same time, the operating costs should be reduced to a great extent by reducing the necessary personnel compared to the required personnel for prior art methods. Also, a simple adjustment with respect to different products should be possible.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
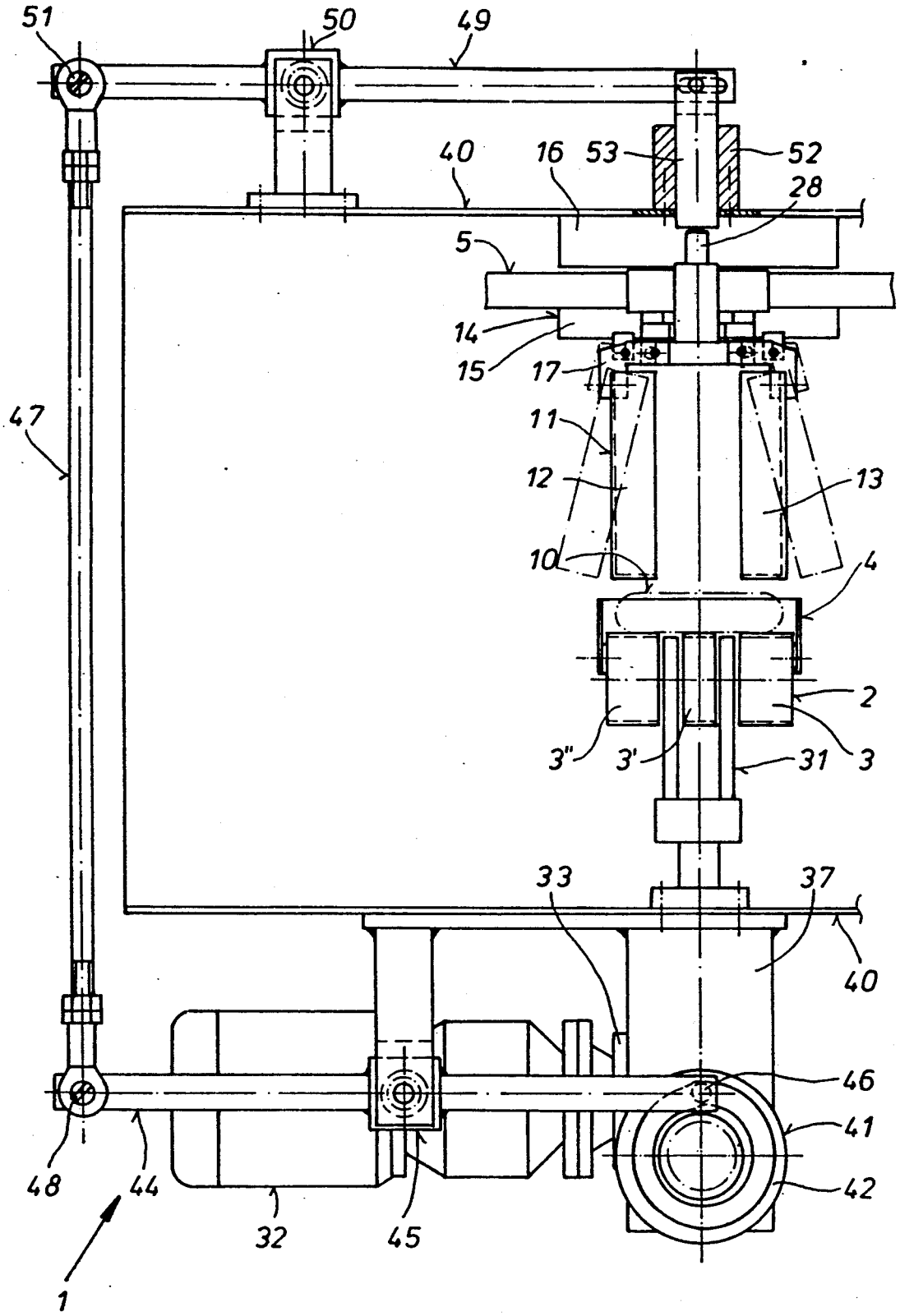
FIG. 1 shows an end view of the apparatus.

The apparatus of the present invention for filling a transport container, especially for filling a transport container with fresh, non-smoked sausages, is primarily characterized by the transport container being arranged vertically above the conveying means that conveys the piece goods toward the transport container and comprising two halves that are controllably adjustable; a lifting device that is arranged under the conveying means and is movable in a direction toward the transport container thereby penetrating the conveying means, and is insertable into the transport container; and a control member that cooperates with the halves of the transport containers and is in a drivable connection with the lifting device, with the control member adjusting in a forced manner one (FIG. 3*a*) or both halves of the transport containers with respect to the lifting movements of the lifting device.

It is preferable that the two halves of the transport containers have a U-shaped cross-section and are disposed, spaced at a distance from one another, at a carrier, which engages a transport device, for example, in the form of a drivable transport disk.

It is advantageous, that the two halves of the transport container are fastened to the carrier via a respective first and respective second angular lever and a respective first and a respective second joint bolt, and an actuation member is provided for adjusting the two halves. The actuation member is vertically movable and acting on a free end of said respective first and second angular levers. The actuation member is in the form of a transverse stay, jointedly connected to the first and second levers via respective bolts that are guided in respective slotted holes. For the adjustment of the actuation member, a slidable thrust bolt is provided which is movable against the force of a spring.

For the controllable adjustment in a forced manner of one or both halves of the transport containers, a control member in the form of a control disk is provided in a simple embodiment of the present invention, whereby the control disk, in a drivable manner, is connected to a drive motor of the lifting device and is connected to the halves of the transport container directly or via intermediate members.

The control disk may be directly connected to the drive motor of the lifting device and may be connected via intermediate members in the form of a linkage that is driving, via a thrust bolt, a pressure bolt of the transport container. It is also possible that the control disk is in a drivable connection with the drive motor of the lifting device via a tooth or belt drive, and via a slide, that is vertically movable by the control disk, to the actuation member of the transport container.

In a further embodiment, the cam of the control disk is provided with two control sections of different diameters, which have a transition into one another and are arranged such that with a first one of the control sections the halves of the transport containers are pivoted away from one another out of a vertical resting position in order to introduce the piece goods, and with a second one of the control sections are returned and arrested in a vertical resting position.

For the controllable adjustment of one or both halves of the transport container, a preferably pneumatically actuatable servo device may be provided (FIG. 1*a*), which acts on the actuating members of the halves of the transport containers and which is controllable with respect to the lifting movements of the lifting device.

The lifting device is preferably driven by a crank gear driven by a drive motor and a gear unit, whereby a crank pin of the crank gear is drivably connected to the lifting device via a vertically movable slide. The two halves of the transport containers may be provided with two or more inwardly extending contact supports.

When filling of transport containers is preformed with the inventive apparatus, an automated process is realized in which fresh, non-smoked sausages that have been portioned and twisted off by a sausage stuffing machine are conveyed to a packing unit without the sausages being manually handled. A continuous process with little operational expenditure and a gentle treatment of the sausages is thus realized.

It is also advantageous that the filling apparatus, with which the sausages may also be stacked in a single or multiple layers in a packing-ready form, enables a high through-put and may also be adjustable to different products, thus a high flexibility and a programmable capacity are provided. Since during the conveying process the sausages are not touched by personnel and no manual handling is necessary, a hygienic processing is ensured. The inventive apparatus thus realizes the further automization of the sausage production process.

DESCRIPTION OF PREFERRED EMBODIMENTS

The present invention will now be described in detail with the aid of several specific embodiments utilizing FIGS. 1 through 5.

Figure 1A:
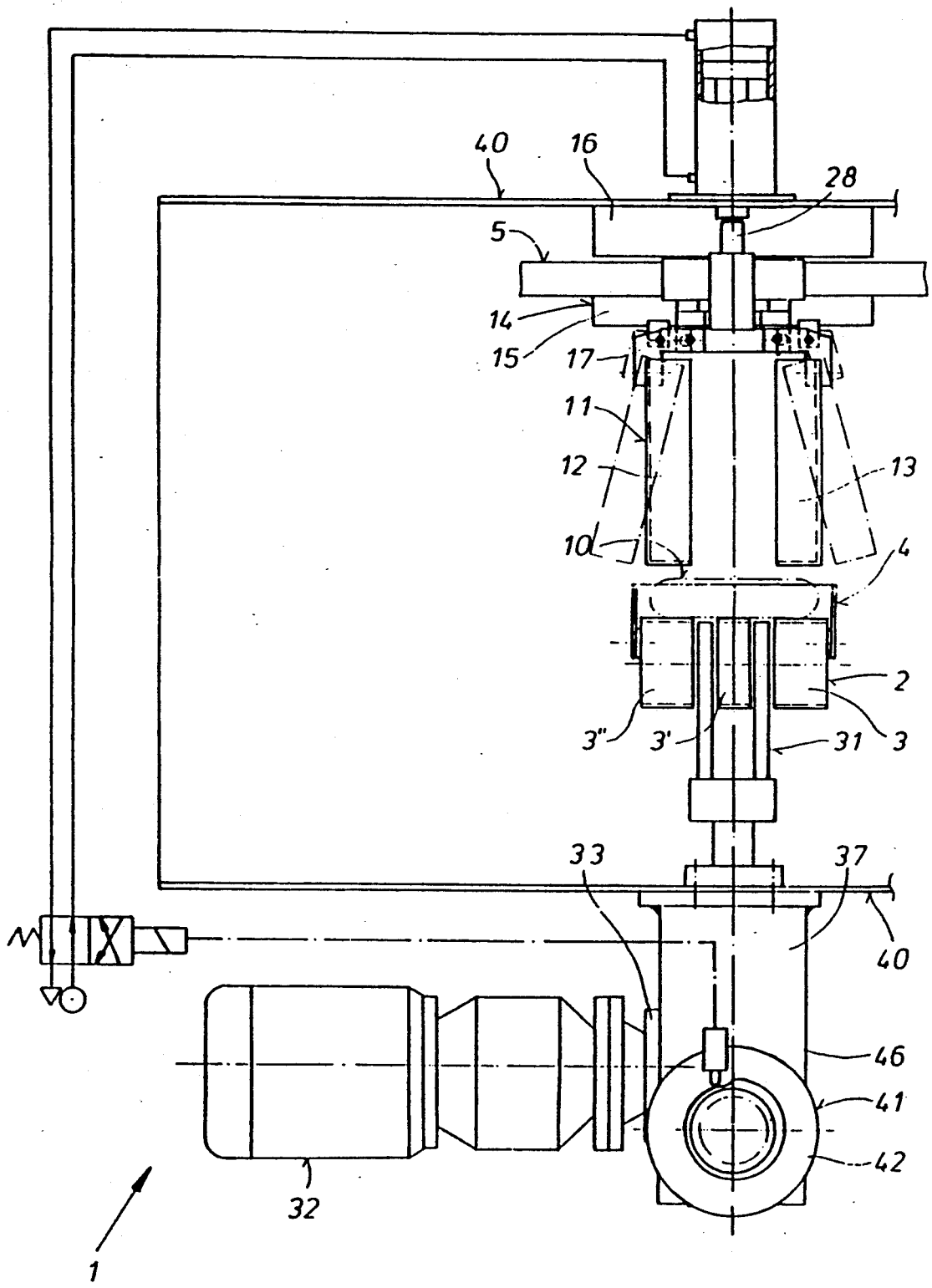
FIG. 1*a* shows an end view of the apparatus according to FIG. 1 in an embodiment with a servo device.
Figure 2:
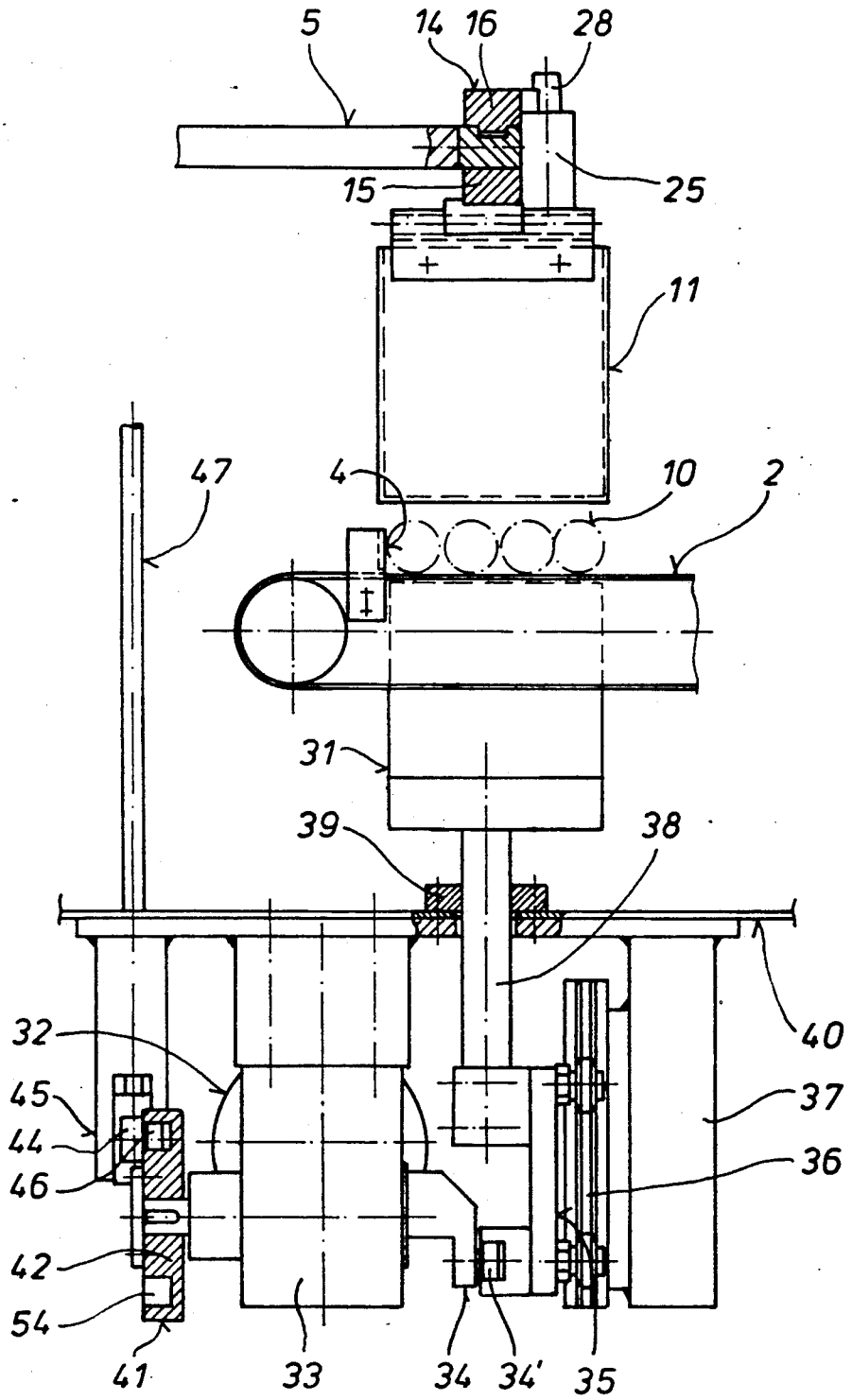
FIG. 2 shows the apparatus of FIG. 1 in a partial side view.

The apparatus 1, represented in FIGS. 1 and 2, is employed for the controllable filling of transport containers 11 with piece goods, for example, with fresh, non-smoked sausages 10, which are conveyed to the machine via a conveying means 2 and are further transported via transport containers 11 and a transport disk 5 to a packing unit that is not represented in the drawings. The sausages 10 are collected and piled up at an abutment 4 which is disposed at the conveying means 2 comprising belt sections 3, 3' and 3". The sausages 10 are then introduced into the transport container 11 which is arranged vertically above the conveying means 2 via the lifting device 31 that penetrates the belt sections 3, 3' and 3". After the transport container 11 has been filled it engages the continuous rotating transport disk 5 and is then transported to the packing unit.

Figure 3:
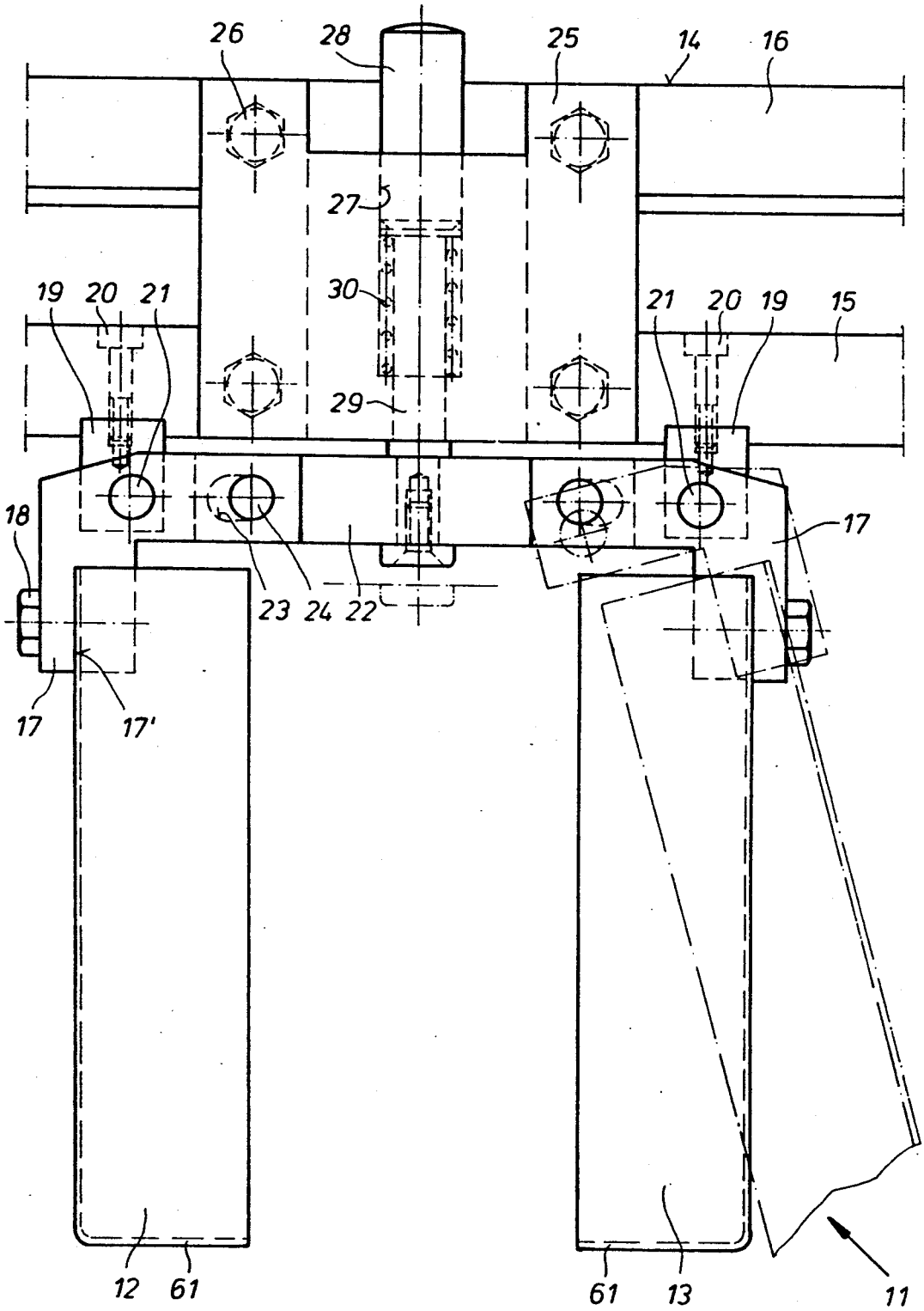
FIG. 3 represents the enlarged end view of a transport container of the apparatus according to FIG. 1.
Figure 3A:
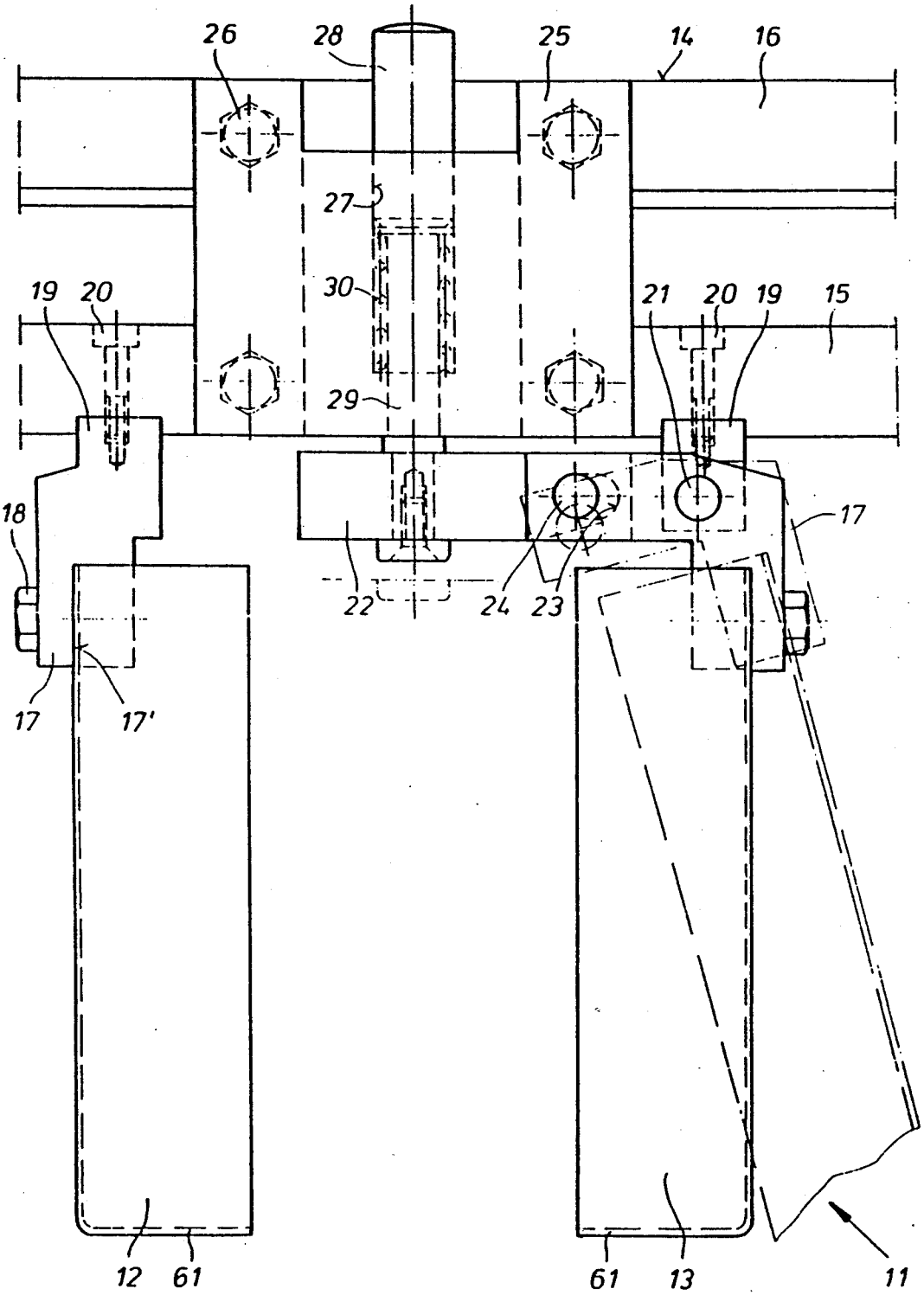
FIG. 3*a* shows a further embodiment according to FIG. 3 in which the second half of the transport container is fixedly connected.
Figure 4:
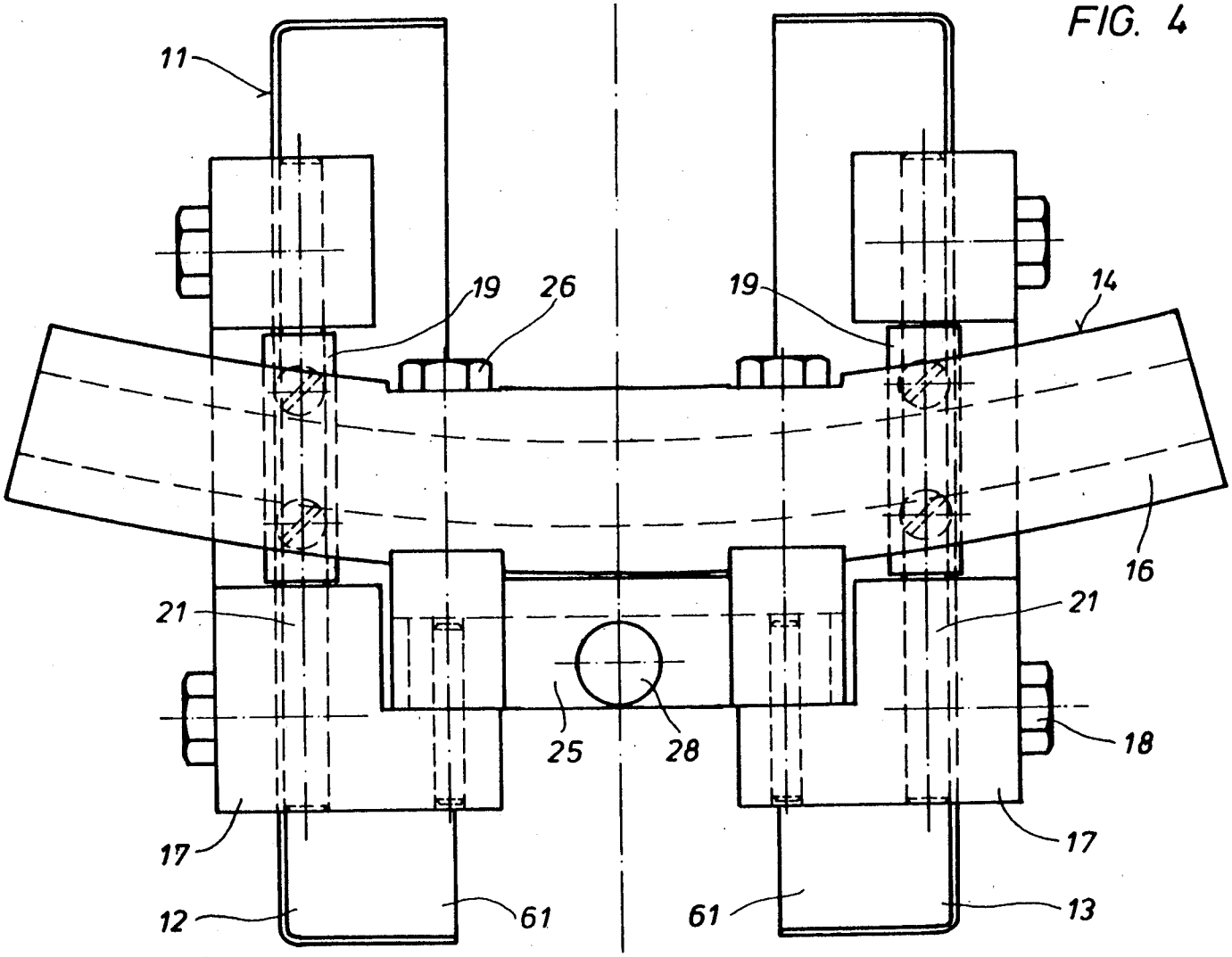
FIG. 4 represents the transport container according to FIG. 3 in a plan view.

The transport container 11 comprises, as can be seen in FIGS. 3 and 4, two halves 12 and 13, which have an essentially U-shaped cross-section, and are arranged, spaced apart from one another, at a carrier 14 that consists of two rails 15 and 16. The halves 12 and 13 are attached to the carrier 16 via levers 17, that are pivotably supported at bearings 19 via joint bolts 21, whereby the bearings 19 are fastened to the rail 15 by screws 20. The halves 12 and 13 engage slots 17' of the levers 17 and are secured via screws 18 at the levers 17. When the levers 17 are pivoted, the halves 12 and 13, as shown in the right half of FIG. 3, are pivoted outwardly and the transport container 11 is opened.

For the pivoting action of the halves 12 and 13 a control element in the form of a transverse stay 22 is provided, which is connected to the free ends of the lever 17 via bolts 24 that are guided in slotted holes 23. A bolt 29 is threaded into the transverse stay 22 thereby penetrating in an upward direction the bearing 25 that is fastened via screws 26 to the rails 15 and 16. The bolt 29 may be actuated via a thrust bolt 28 which is guided in a boring 27 of the bearing 25. When the thrust bolt 28 is pushed downward, the bolt 29 is moved in a downward direction against the force of a spring 30 that is also arranged in the boring 27, whereby the transverse stay 22 is also moved so that the halves 12 and 13 of the transport container 11. When the pressure exerted on the thrust bolt 28 ceases, the force of the loaded pressure spring 30 forces the bolt 29, and also the halves 12 and 13, back into the represented resting position.

In order to activate the lifting device 31 a drive motor 32 which is connected to a gear unit 33 is provided. The gear unit 33 is further connected to a crank gear 34 having a crank pin 34' that engages a slide 35 which is movably guided at a rail 36. The rotation of the crank gear 34 is thus transformed into an axial adjusting movement of a push rod 38 that is fastened to the slide 35 and is movable within a bearing 39. The guiding rail 36 is connected to a holder 37 which is welded to a support frame 40 of the apparatus 1.

In order to synchronize the opening and closing movements of the transport container 11 with respect to the adjusting movements of the lifting device 31, a control member 41 in the form of a control disk 42 having a cam 54 is provided on a drive shaft 43 of the gear unit 33. The control disk 42 engages the thrust bolt 28 via intermediate members. The intermediate members are formed by levers 44, 47, and 49, which are connected to one another via joint connections 48 and 51. The levers 44 and 49 are pivotably arranged in bearings 45 and 50. An adjusting movement of a lug 46, which engages the cam 54 of the control disk 42 and is connected to the lever 44, is therefore transmitted to a push rod 53 at the end of the lever 49, which is slidably guided in a bearing 52 and engages the thrust bolt 28.

Figure 5:
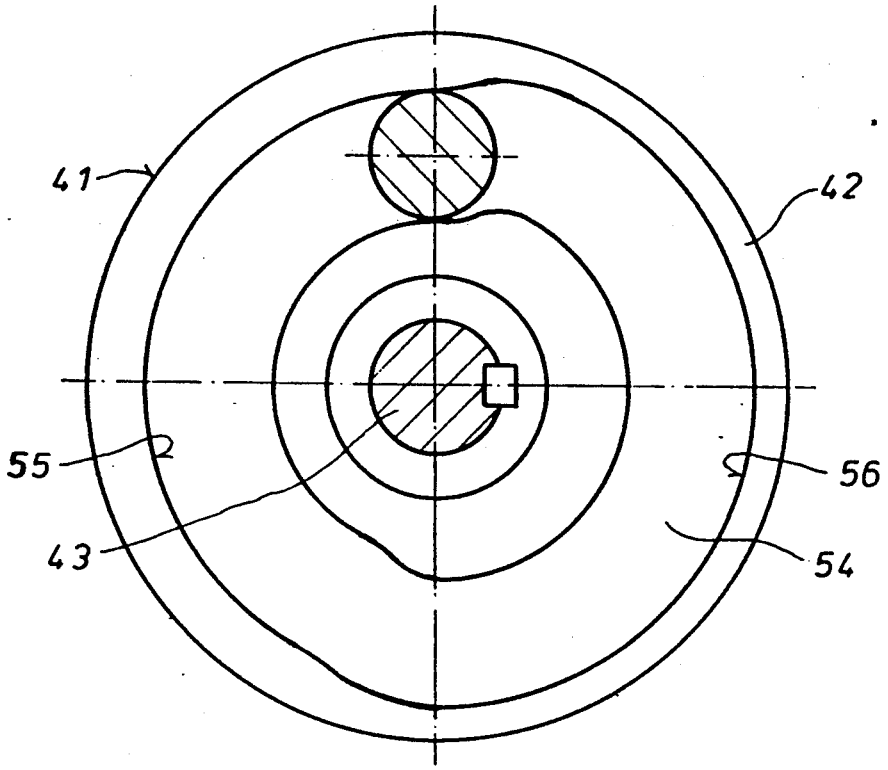
FIG. 5 is an enlarged view of the control member in the form of a control disk of the apparatus according to FIG. 1.

The cam 54 of the control disk 42 as can be seen in FIG. 5, is provided with two control sections 55 and 56 having a different diameter and a transition into one another, whereby the control sections 55 and 65 are arranged such that with the first control section 55 the halves 12 and 13 of the transport containers 11 are pivoted sideways, so that the lifting device 31 which is carrying the sausages 10 may be introduced into the transport container 11. With the other control section 56 the halves 12 and 13 which are provided with contact supports 61 are arrested in a vertical resting position. Since the lifting device 31 may be introduced repeatedly into the transport container 11 before the transport container engages the transport disk 5, sausages 10 may be stacked in multiple layers into the transport container 11 thus being packing-ready.

Figure 6:
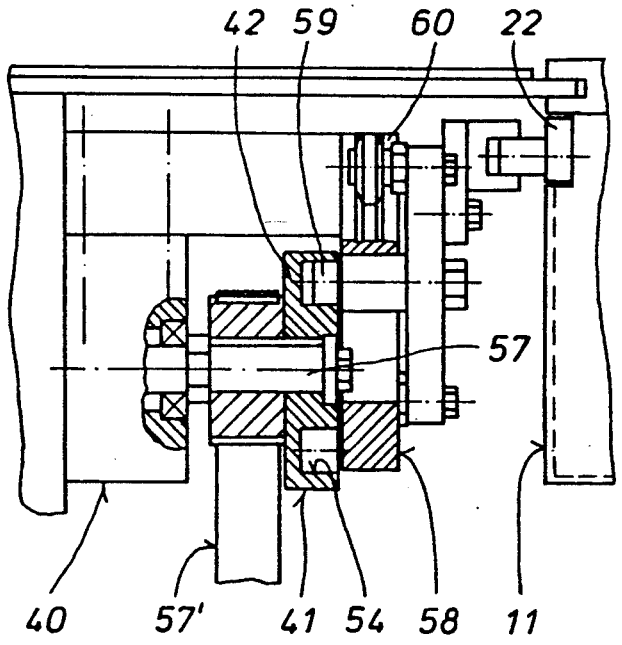
FIG. 6 represents a further embodiment of the control member of the apparatus according to FIG. 1.

According to the embodiments represented in FIG. 6, the control member 41 may also be provided with a shaft 57 in the area of the transport container 11 The shaft 57 is drivably connected via a belt drive 57' to the drive motor 32. A lug 59 that is fastened to a slide 58 engages the cam 54 of the control disk 42. The slide 58 is slidably guided in a rail 60 which is fastened to a support frame 40. The slide 58 is drivably connected to the transverse stay 22 of the transport container 11. The rotation of the control disk 42, which occurs with respect to the adjusting movements of the lifting device 31, is thus transformed into an axial adjusting movement and is transmitted to the transverse stay 22 by which the lever 17 is actuated.

The sausages 10 that are conveyed via the conveyor means 2 are collected at the abutment 4 and are introduced into the transport container 11 via the lifting device 31 in single or multiple layers. The halves 12 and 13 of the transport container 11 are opened and closed with respect to the adjusting movements of the lifting device 31 with the aid of the control member 41. During the retraction of the lifting device 31 the sausages 10 are deposited onto the contact supports 61. After the transport container 11 has been filled it engages the transport disk 5 and is then transported to the packing unit, where the sausages 10 arranged in packing-ready layers are then packed.

The present invention is, of course, in no way restricted to the specific disclosure of the specification and drawings, but also encompasses any modifications within the scope of the appended claims.

What we claim is:

1. An apparatus for controlled filling of a transport container with piece goods, comprising:

a conveying means for conveying said piece goods toward said transport container, with said transport container being arranged vertically above said conveying means and being formed of two halves that are adjustable relative to one another in a controllable manner;

a lifting device arranged under said conveying means and movable in a direction toward said transport container, thereby penetrating said conveying means, and further being insertable into said transport container;

a control member cooperating with said halves of said transport container and driveably connected to said lifting device, with said control member adjusting in a forced manner said halves of said transport container with respect to lifting movements of said lifting device; and said halves of said transport container having U-shaped cross-section and are disposed, spaced at a distance from one another, at a carrier that engages a transport device.

2. An apparatus according to claim 1, wherein said transport device is in the form of a transport disk.

3. An apparatus according to claim 1, further comprising a respective first and a respective second angular lever and a respective first and a respective second joint bolt for fastening said halves of said transport container to said carrier, and an actuation member for adjusting said two halves, with said actuation member being vertically movable and acting on a free end of said respective first and second angular levers.

4. An apparatus according to claim 3, wherein said actuation member is in the form of a transverse stay that is jointedly connected to said first and second levers via respective bolts guided in respective slotted holes.

5. An apparatus according to claim 3, further comprising a thrust bolt movable against a force of a spring for adjusting said actuation member 22.

6. An apparatus according to claim 1, wherein, for controllably adjusting relative to one another in a forced manner said halves of said transport container, said control member is in the form of a control disk.

7. An apparatus according to claim 6, wherein only one of said halves is adjusted via said control disk.

8. An apparatus according to claim 6, wherein said lifting device further comprises a drive motor, and wherein said control disk, in a driveable manner, is directly connected to said drive motor of said lifting device and to said halves.

9. An apparatus according to claim 6, further comprising intermediate members, and said lifting device further comprising a drive motor, with said control disk, in a driveable manner, being connected via said intermediate members to said drive motor of said lifting device and to said halves.

10. An apparatus according to claim 6, further comprising intermediate members, a push rod, and an actuation member for adjusting said two halves, said actuation member comprising a thrust bolt, and said lifting device further comprising a drive motor, with said control disk, in a driveable manner, being directly connected to said drive motor of said lifting device and connected via said intermediate members to said push rod that actuates said thrust bolt of said actuation member.

11. An apparatus according to claim 6, further comprising a tooth-wheel drive, a slide, and an actuation member for adjusting said two halves, and said lifting member further comprising a drive motor, with said control disk, in a driveable manner, being connected via said tooth-wheel drive to said drive motor of said lifting device and via said slide, that is adjustable by said control disk, to said actuation member.

12. An apparatus according to claim 6, further comprising a belt drive, a slide and an actuation device for said transport container, and said lifting device further comprising a drive motor, with said control disk, in a driveable manner, being connected via said belt drive to said drive motor of said lifting device and via said slide, that is adjustable by said control disk, to said actuation member.

13. An apparatus according to claim 6, wherein said control disk has a cam with two control sections of different diameters, with said control sections having a transition into one another and being arranged such that with a first one of said control sections said halves of said transport container are pivoted away from one another out of a vertical resting position and with a second one of said control sections said halves are returned to and arrested in said vertical resting position.

14. An apparatus according to claim 3, further comprising a pneumatically actuatable servo device for controllably adjusting said halves of said transport container, said pneumatically actuatable servo device acting on said actuation member and being controllable with respect to said lifting movements of said lifting device.

15. An apparatus according to claim 1, wherein said lifting device further comprises a drive motor, a gear crank, a vertically movable slide and a gear unit, with said crank gear having a crank pin being driveably connected to said lifting device via said vertically movable slide.

16. An apparatus according to claim 1, wherein each of said halves of said transport container has at least two inwardly extending contact supports.

* * * * *